US007004069B2

(12) United States Patent
Schmid et al.

(10) Patent No.: US 7,004,069 B2
(45) Date of Patent: Feb. 28, 2006

(54) APPARATUS FOR A STABLE MACHINE RUN ON PRINTING UNITS OF A ROTARY PRESS FOR OPERATION WITH PART-WIDTH PRINTING MATERIAL

(75) Inventors: Georg Schmid, Neusäss (DE); Martin Endisch, Wertingen (DE); Josef Singler, Binswangen (DE); Konrad Brummer, Inchenhofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/767,887

(22) Filed: Jan. 28, 2004

(65) Prior Publication Data

US 2004/0182263 A1 Sep. 23, 2004

(30) Foreign Application Priority Data

Jan. 30, 2003 (DE) ..... 103 03 608

(51) Int. Cl.
*B41F 35/00* (2006.01)

(52) U.S. Cl. ..... 101/483; 101/423

(58) Field of Classification Search ..... 101/483, 101/423–425, 147, 148, 366
See application file for complete search history.

(56) References Cited

U.S. PATENT DOCUMENTS

| | | | | |
|---|---|---|---|---|
| 2,236,805 | A | 4/1941 | Plaisted | 101/365 |
| 5,046,416 | A | 9/1991 | Freyer et al. | 101/148 |
| 5,303,652 | A * | 4/1994 | Gasparrini et al. | 101/425 |
| 5,553,546 | A * | 9/1996 | Hoff | 101/483 |
| 5,884,558 | A * | 3/1999 | Nakamura et al. | 101/148 |
| 6,016,751 | A * | 1/2000 | Hess | 101/484 |
| 2002/0100379 | A1 * | 8/2002 | Wiese | 101/148 |

FOREIGN PATENT DOCUMENTS

WO WO 02058931 A2 8/2002

* cited by examiner

*Primary Examiner*—Anthony H. Nguyen
(74) *Attorney, Agent, or Firm*—Cohen, Pontani, Lieberman & Pavane

(57) ABSTRACT

A non-flowing protective medium is applied in a finely distributed manner through a metering nozzle by means of blown air to the non-printing regions of at least one roll of an inking unit or damping unit and/or the non-printing regions of at least one transfer cylinder or forme cylinder, forming a thin-layer protective film. Ink is thereby prevented from drying out in non-printing regions of the rolls and cylinders of the printing unit, and the tack is thus kept at a low level, in order to reduce the risk of web breaks.

11 Claims, 4 Drawing Sheets

APPARATUS FOR A STABLE MACHINE RUN ON PRINTING UNITS OF A ROTARY PRESS FOR OPERATION WITH PART-WIDTH PRINTING MATERIAL

BACKGROUND OF THE INVENTION

1. Field of the Invention

The invention relates to an apparatus for a stable machine run on printing units of a rotary press for operation with part-width printing material 2. Description of the Related Art WO 02058931 A2 discloses an apparatus for improving the printing process, for example during production with part-width paper webs, a solvent which dissolves or breaks down the printing ink being applied or being applied drop by drop to the non-printing regions of the rolls of the inking unit, in particular to the two ends of these rolls, in order to prevent the printing ink applied and accumulating at the ends of the rolls losing solvent and thus to prevent the resultant drying-out and sticking of the printing ink.

The disadvantage is that the solvent applied to the rolls or in the edge region of the rolls sprays off over time and with increasing speed and soils the press. Furthermore, drying problems can occur at the edge of the paper web, it being possible for smearing in the dryer or set-off and/or marking in the folder superstructure or in the folding unit to occur as a result.

SUMMARY OF THE INVENTION

The invention eliminates the aforementioned disadvantages and provides an apparatus for a stable machine run on printing units of a rotary offset press for operation with alternating and part-width printing material, by means of which the ink is prevented from drying out in the non-printing regions of the rolls and cylinders of the printing unit, and thus the tack, as it is known, is kept at a low level, in order to reduce the risk of web breaks, and to reduce the loading on the rolls and rubber blankets (sleeves).

It is significant that, by means of the apparatus, a non-flowing medium, for example a commercially available roll paste or a roll grease, is applied in a finely distributed manner by means of blown air to the non-printing regions of a cylinder or a roll in the inking unit or damping unit.

The non-flowing medium adheres to the surface of the cylinder or the roll and prevents the ink drying out and accumulating.

The non-flowing medium is applied in a finely distributed manner by means of compressed air to the surface, that is to say to the non-printing regions, of the cylinder or the roll in the inking or damping unit by a pump system with a distributor unit. The non-flowing medium can be applied, for example by means of a metering nozzle, to the rider roll, for example a ceramic rider roll, or to any other ingoing nip. As a result of splitting processes, the non-flowing medium is distributed to the non-printing regions in the entire inking unit or in the entire roll frame.

During operation with a part-width web, ink accumulates in the non-printing zones. Therefore, doctor units can additionally be thrown onto the non-printing regions of the rider roll, in order to remove the mixture of printing ink and non-flowing medium which adheres and accumulates in the course of the printing process. As a result of the axial movement of the distributor cylinder in an inking unit, during the printing process the ink has the property of migrating outwards on the individual rolls and/or cylinders and of building up on the rolls. The build-up of ink firstly causes splashing and soiling of the machine, and secondly the build-up of ink causes higher wear of the rolls and rubber blankets and reduces their lifetime.

The doctor units now provide the possibility of producing an ink flow, by the doctor unit removing the ink from the rider roll and feeding it to the ink collecting container. If the doctors are displaced axially on their holding unit, or are arranged in a specific way, separation of ink on the roll or adaptations to narrower printing materials can also be carried out.

The doctors firstly determine the track width of the ink stripe. However, since a plurality of doctors can be arranged close beside one another, the entire region which is intended to remain free of ink can be covered, so that propagation of ink over the track width is prevented with certainty, even in the case of a relatively long printing time. However, the width of the individual doctors can also be adapted to the width of the ink-free zone, the doctors of different width being arranged to be replaceable.

The operation of the doctor units is carried out from the control desk. For example, after a time cycle which can be set at the control desk, the ink/protective medium mixture can be removed by the doctor device, for example from the rider roll or other rolls and/or cylinders, it being possible for both the throw-off and throw-on times to be chosen freely in accordance with the production requirements. After each throw-on or doctoring operation, with a short time delay a fresh non-flowing protective medium, for example roll paste, is applied and the cycle begins again. The doctors can be thrown on and off by means of a pneumatic cylinder, it being possible for the contact pressure of the doctor on the rider roll to be adjusted. The doctor must be thrown on uniformly but only lightly in order to prevent excessively high wear.

By means of automated metering of roll paste in the edge regions of the inking unit or of the printing unit, particularly in the case of part-width production runs, the loading on the rubber cylinder sleeve, the rubber blanket and the inking rolls can be reduced.

Depending on the width of the printing material, a corresponding number of doctor blades have to be applied.

The ink/protective medium mixture removed by the doctor is collected in an ink trough which is arranged underneath the doctor. This has to be emptied from time to time.

At least two lubrication points are provided on a printing unit, in order to be able to apply the non-flowing medium to the non-printing regions.

The invention is explained in more detail below using an exemplary embodiment and the highly schematic figures.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PRESENTLY PREFERRED EMBODIMENTS

Figure 1:
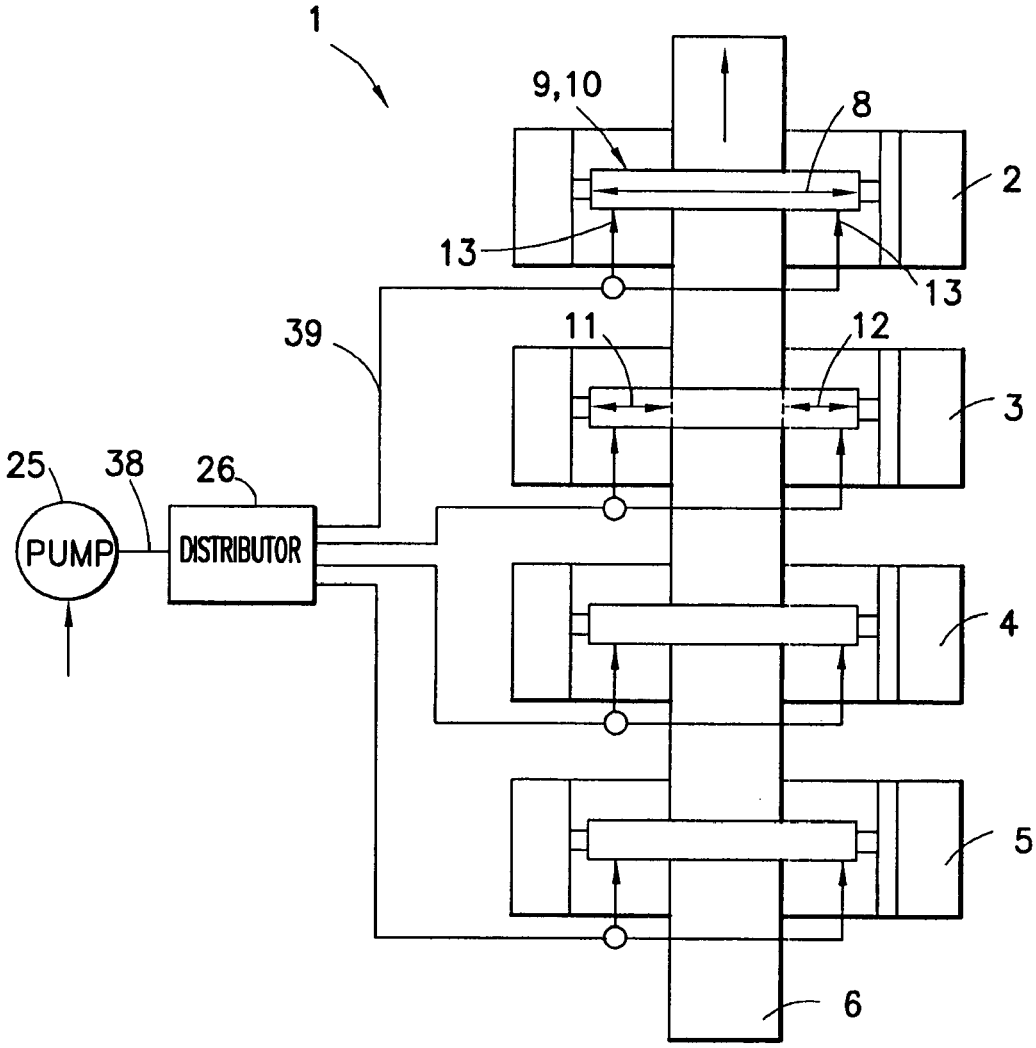
FIG. 1 shows a rotary offset press with an apparatus for a stable machine run for production with part-width printing material.

FIG. 1 shows a rotary offset press 1 comprising four printing units 2 to 5, it being possible for the printing units 2 to 5 to print a printing material 6 on both sides, for example. The printing material 6 shown in FIG. 1 does not exhaust the entire printing width 8 of individual rolls 9 and cylinders 10 of the printing units 2 to 5, so that non-printing regions 11 and 12 are produced at the respective edge zones of the rolls 9 and cylinders 10. The printing units 2 to 5 thus print a part-width printing material 6. Arranged in the non-printing regions 11 and 12 are metering nozzles 13, by means of which, with the aid of blown (compressed) air, a non-flowing protective medium is applied in a finely distributed manner to the surface of the respective rolls 9 and/or cylinders 10. The protective medium is in the viscosity range from about 300 to 400 dPa*s.

Figure 2:
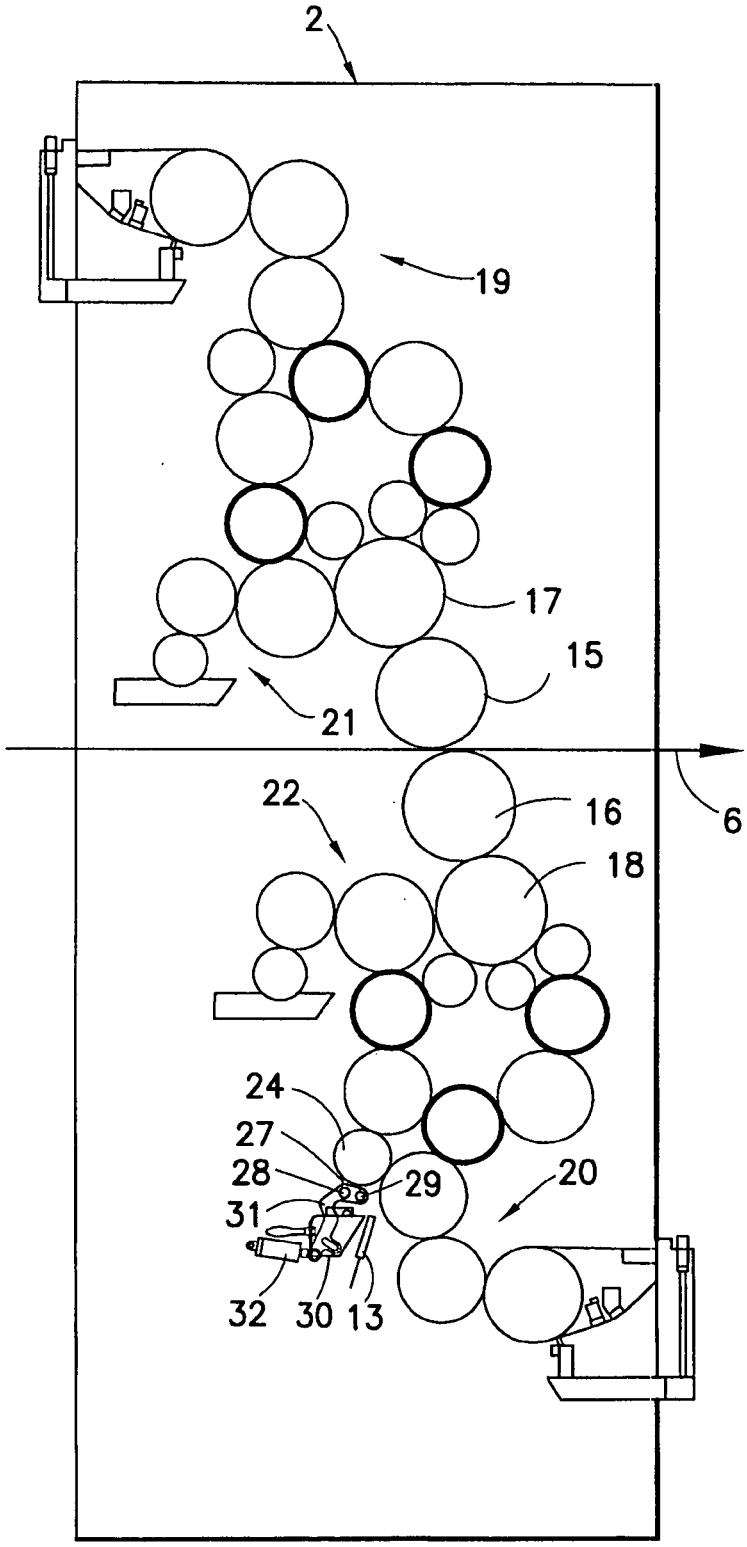
FIG. 2 shows a side view of a printing unit of the rotary offset press according to FIG. 1.

FIG. 2 shows one of the printing units 2 to 5, the printing material 6 being led through between two transfer cylinders 15, 16 and printed on both sides. The transfer cylinders 15, 16 are connected to forme cylinders 17, 18, the forme cylinders 17, 18 being supplied with printing ink and damping solution by inking units 19, 20 and damping units 21, 22 built up from a plurality of rolls. On at least one of the rolls of the inking units 19, 20 and/or damping units 21, 22 and/or on one of the cylinders 15 to 18, a doctor unit 23 can be thrown on and off its non-printing regions 11, 12.

For example, as illustrated in FIG. 2, the doctor unit 23 can be thrown on and off a rider roll 24 of the inking-unit and damping-unit roll train. The metering nozzles 13 are arranged, for example, on the rider roll 24 and/or on an ingoing nip 40 between a transfer roll 7 and the rider roll 24, or on any desired ingoing nip. By means of splitting processes, the non-flowing protective medium is distributed to the non-printing regions 11, 12 in the entire inking unit 19, 20 or in the entire roll frame corresponding to the width of the non-printing region 11, 12. The metering nozzles 13 can be positioned and/or activated appropriately in accordance with the width of the non-printing region 11, 12, it being possible for a plurality of metering nozzles 13 to be arranged on the non-printing regions 11, 12 and activated and/or positioned by means of a computer and/or control unit, driven by means of the control desk or by means of the machine control system. The metering nozzles 13 are supplied with the protective medium, for example by a pump system 25 with distributor unit 26. In this case, the control or regulation of the amount metered and application period of protective medium, is carried out by means of a control unit 50 of the machine control system, applying the protective medium and/or doctoring off the mixture of protective medium and printing ink being controlled while taking account of the general operating states, in particular printing material width, running speed of the machine, length of the print job and temperatures in the roll frame and in the cylinder group.

Although not specifically illustrated, a rotary offset press 1 can be equipped with a plurality of pump systems 25 for different printing units 2 to 5 and/or for different printing inks to be processed by means of the printing units 2 to 5.

Figure 5:
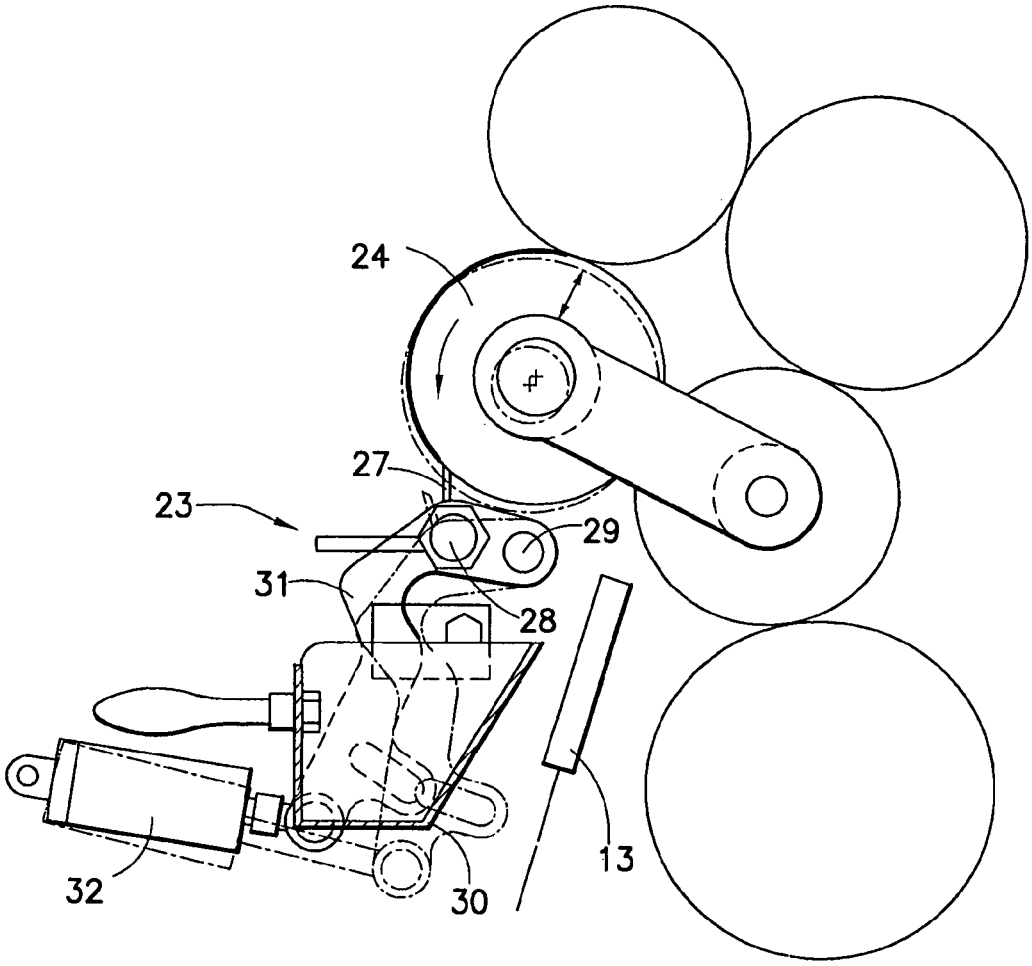

The doctor unit 23 according to the invention (see FIG. 5), for example comprising one or more doctors 27 and a rotational element which is not specifically illustrated, extends parallel to the rider roll 24 and can thus be thrown onto the latter, the doctor unit 23 being capable of removing the mixture of printing ink and non-flowing protective medium on the rider roll 24.

One or more doctors 27 are thrown onto the circumferential surface of the rotational element which can be thrown onto the rider roll 24, or onto the circumferential surface of the rider roll 24. These doctors 27 are fixed with the aid of a clamping unit 28 to a rod 29 whose axis likewise runs parallel to the rider roll 24. The mixture of printing ink and non-flowing protective medium removed from the circumferential surface by the doctor 27 is taken away into a collecting container 30 arranged underneath the doctor 27.

If the doctors 27 are displaced axially on the rod 29 or are arranged in a specific way, adaptations to the respective width of the printing materials 6 can also be carried out.

The width of the individual doctors 27 can also be adapted to the width of the non-printing regions 11, 12, the doctors 27 of different width being arranged to be replaceable.

The doctor unit 23 is mounted in lever arms 31, which are connected to a pressure-medium-operated cylinder 32, the doctor unit 23 being thrown onto and off the doctor roll 24 by means of this cylinder 32.

Figure 3:
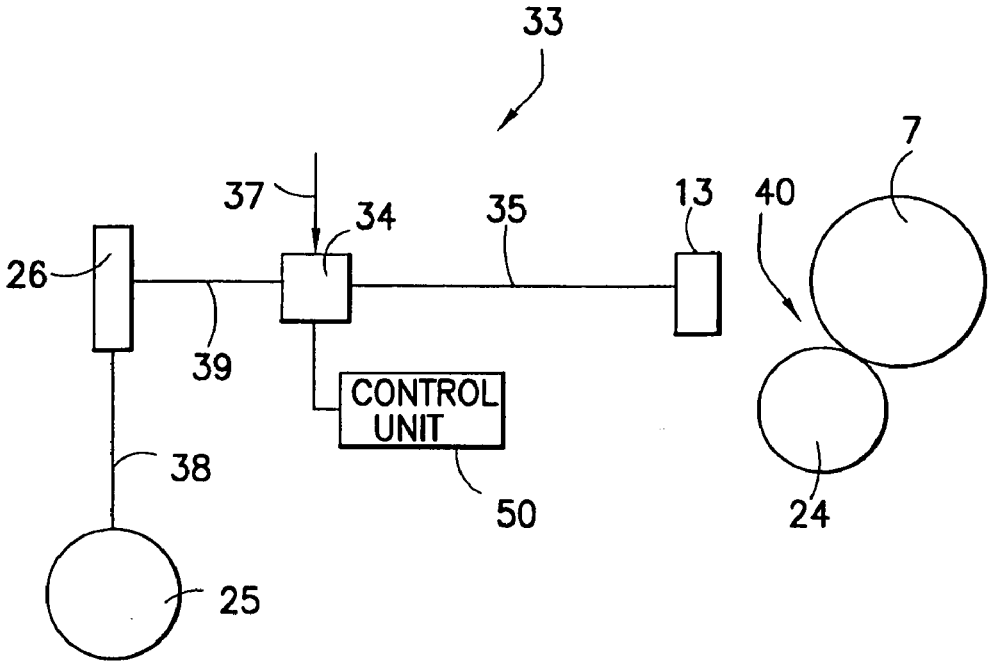
FIG. 3 shows a metering unit.

FIG. 3 shows a metering unit 33 which comprises a pneumatically actuated valve 34, by which means protective medium is metered into a blown-air line 35 in a defined time. The protective medium is conveyed to the metering valve 34 by means of the pump system 25 via the distributor unit 26 and lines 38, 39. While the compressed air line 35 is pressurized, a small quantity of protective medium is led into the compressed air stream 37. As a result of the intensive compressed air flow, the protective medium is broken up and applied in a finely distributed manner to the surface of the transfer roll 7 and/or rider roll 24 by the metering nozzles 13.

Figure 4:
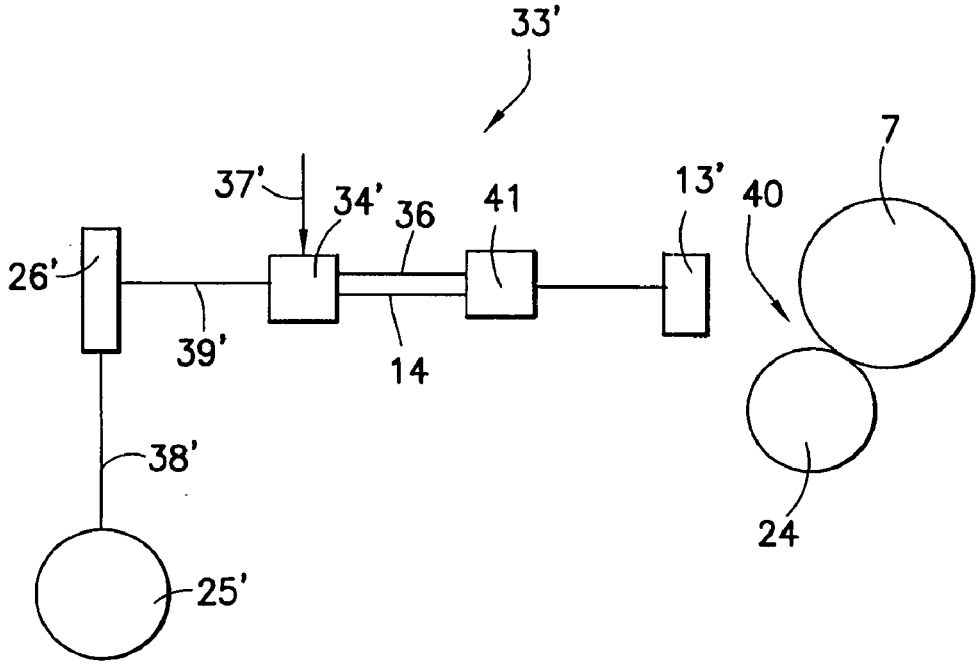
FIG. 4 shows a metering unit and FIG. 5 shows an apparatus for a stable machine run according to FIG. 2.

FIG. 4 shows a further metering unit 33' which comprises at least two pneumatically actuated valves 34', 41, a chamber 36 for metering the protective medium being formed between the first valve 34' and the second valve 41. The protective medium is conveyed into the chamber 36 by means of the pump system 25' via the distributor unit 26' and lines 38', 39', the first valve 34' being opened and the second valve 41 remaining closed. After an appropriate time period, the chamber 36 has been filled with protective medium completely or partially, depending on the quantity required, the first valve 34' being closed. In order to blow out the protective medium metered into the chamber 36, first of all the second valve 41 is opened and the first valve 34' is pressurized with compressed air 37'. The compressed air 37' penetrating into the chamber 36 in a pulsed manner or in the manner of a surge, for example, blows out the metered protective medium, the latter being applied in a finely distributed manner to the surface of the respective transfer roll 7 and/or rider roll 24 by the metering nozzles 13'.

The invention is not intended to be restricted just to use in rotary offset presses, in particular sheet-fed or web-fed rotary offset presses. The apparatus can also be used on rotary letterpress presses, for example presses for flexographic printing, or rotogravure presses.

The invention is not limited by the embodiments described above which are presented as examples only but can be modified in various ways within the scope of protection defined by the appended patent claims.

We claim:

1. A rotary printing press comprising a plurality of printing units for operation with part width printing material, each said unit comprising:

an inking unit having at least one roll having non-printing regions, said inking unit including a rider roll, a transfer roll, and a doctor unit which can be thrown off and on said non-printing regions of said rider roll so that a mixture of printing ink and protective medium can be removed as required from said non-printing regions of said rider roll;

a damping unit having at least one roll having non-printing regions;

a forme cylinder having non-printing regions;

a transfer cylinder having non-printing regions;

a source of protective medium having a viscosity of 300 to 400 dPa*s; and at least one metering nozzle arranged to apply said protective medium in a finely distributed manner to at least one of said non-printing regions by means of compressed air, thereby forming a thin-layer protective film on said at least one of said non-printing regions.

2. A rotary printing press as in claim 1 wherein said at least one metering nozzle is arranged to apply said protective medium to said non-printing regions of said rider roll and said transfer roll.

3. A rotary printing press as in claim 2 wherein said rider roll and said transfer roll form a nip having an ingoing side, said at least one metering nozzle being arranged to apply said protective medium to said ingoing side of said nip.

4. A rotary printing press as in claim 1 further comprising, for each said metering nozzle, a compressed air line connected to said nozzle and a metering unit comprising a pneumatically actuated valve which meters said protective medium into said compressed air line.

5. A rotary printing press as in claim 1 further comprising, for each said metering nozzle, a metering unit comprising first and second pneumatically actuated valves, and a chamber formed between said first and second valves, said first valve being actuatable to blow protective medium in said chamber through said second valve to said nozzle.

6. A rotary printing press as claim 1 wherein said metering nozzle can apply a protective medium having a viscosity in a range between 300 and 400 dPa.

7. A rotary printing press as in claim 1 further comprising a control unit for controlling time and movement sequences of throwing said at least one doctor unit on and off said non-printing regions, and of applying said protective medium.

8. A rotary printing press as in claim 7 wherein said control unit takes account of general operating states including printing material width, running speed of the press, length of a print job, and temperatures in said rolls and cylinders.

9. A method of forming a thin-layer protective film on non-printing regions of at least one of a roll of an inking unit, a roll of a damping unit, a forme cylinder, and a transfer cylinder in a printing unit of a rotary printing machine, the inking unit including a rider roll, a transfer roll, and a doctor unit which can be thrown off and on non-printing regions of the rider roll, said method comprising:

arranging at least one metering nozzle to apply a protective medium having a viscosity in the range of 300 to 400 dPa*s in a finely distributed manner to at least one of the non-printing regions by means of compressed air, and applying a protective medium having a viscosity from about 300 to 400 dPa*s to at least one of the non-printing regions by means of compressed air, thereby forming a thin-layer protective film on the at least one of the non-printing regions; and selectively throwing the doctor unit off and on the non-printing regions of the rider roll for removing a mixture of printing ink and protective medium as required from the non-printing regions of the rider roll.

10. The method of claim 9 wherein the protective medium is metered into a compressed air line connected to the nozzle.

11. The method of claim 9 wherein the protective medium is one of roll paste and roll grease.

* * * * *